United States Patent [19]

Hayes

[11] Patent Number: 4,979,319

[45] Date of Patent: Dec. 25, 1990

[54] SKI BOOT AND SPORT SHOE ASSEMBLY

[76] Inventor: Jaye B. Hayes, 691 Orchard Dr., NW., Lancaster, Ohio 43130

[21] Appl. No.: 399,022

[22] Filed: Aug. 28, 1989

Related U.S. Application Data

[62] Division of Ser. No. 198,988, May 26, 1988, Pat. No. 4,879,822, which is a division of Ser. No. 869,279, Jun. 2, 1986, Pat. No. 4,747,221.

[51] Int. Cl.[5] ..... A43B 5/4; A43B 3/16

[52] U.S. Cl. ..... 36/117; 36/7.1 R; 36/114

[58] Field of Search ..... 36/117–121, 36/114, 93, 105, 7.1, 7.3, 7.5, 116, 113, 25 R; 280/615

[56] References Cited

U.S. PATENT DOCUMENTS

| | | | |
|---|---|---|---|
| 4,041,619 | 8/1977 | Sapper | 36/25 R |
| 4,102,063 | 7/1978 | Ihlen | 36/117 |

FOREIGN PATENT DOCUMENTS

| | | | |
|---|---|---|---|
| 0020315 | 12/1980 | European Pat. Off. | 36/117 |
| 120293 | 10/1984 | European Pat. Off. | 36/117 |
| 2434218 | 2/1976 | Fed. Rep. of Germany | 36/117 |
| 2925554 | 1/1981 | Fed. Rep. of Germany | 36/117 |
| 3115618 | 3/1982 | Fed. Rep. of Germany | 280/615 |
| 2492233 | 4/1982 | France | 36/119 |

*Primary Examiner*—Paul T. Sewell
*Assistant Examiner*—Ted Kavanaugh
*Attorney, Agent, or Firm*—Lawrence J. Shurupoff

[57] ABSTRACT

A ski boot system includes a rigid outer boot having contoured support surfaces for supporting and suspending any one of a plurality of varying sized pliable inner sport shoes. The inner sport shoe is provided with rigid engagement surfaces formed to complement the support surfaces of the outer boot. In this manner, a relatively inelastic and rigid connection is provided to positively secure the shoes within the boot.

5 Claims, 3 Drawing Sheets

27
37
31
41
29
39
33
35
25
23
7
5
A
B
C
X

FIG 16
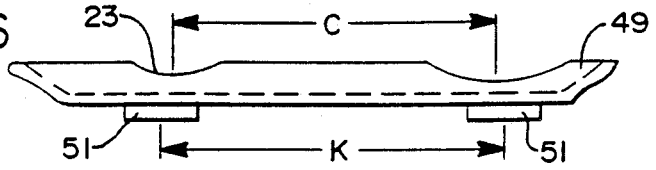
FIG 17
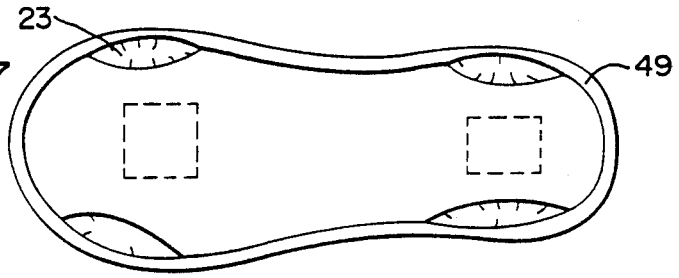
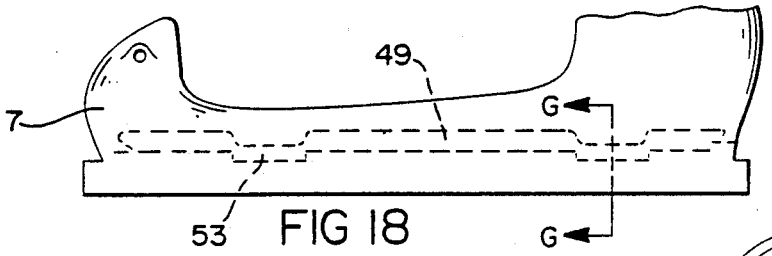
FIG 18
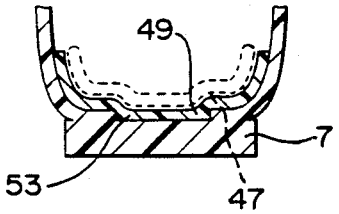
FIG 19
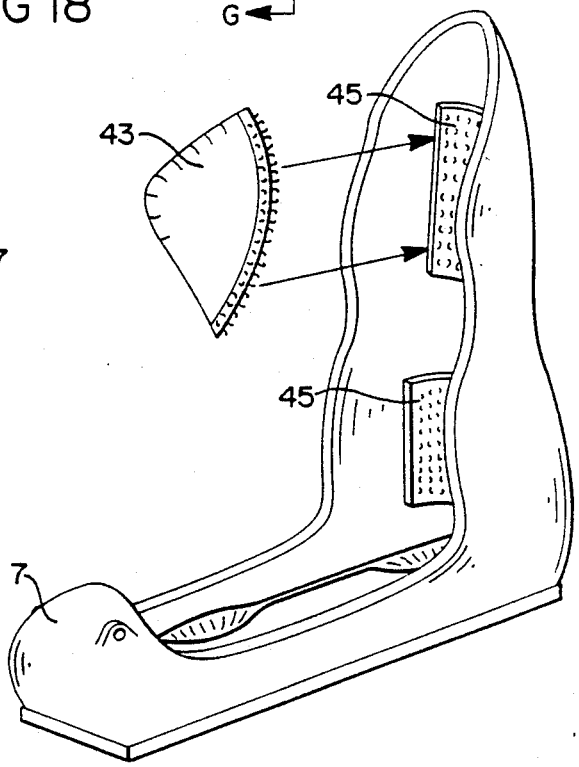
FIG 20

SKI BOOT AND SPORT SHOE ASSEMBLY

This is a division of application Ser. No. 198,988, filed May 26, 1988 now U.S. Pat. No. 4,879,822 which is a division of 06/869,279, filed June 2, 1986 now U.S. Pat. No. 4,747,221.

BACKGROUND OF THE INVENTION

1. Field of the Invention

This invention relates generally to ski boots and more particularly relates to a rigid outer ski boot for providing support around a pliable inner sport shoe.

2. Description of Prior Developments

Although conventional ski boots adequately serve their purpose of rigidly supporting a skier's foot and ankle, several longstanding drawbacks have heretofore been associated with these boots. Anyone who has walked in a pair of ski boots well knows the discomfort caused by their rigid and unyielding structure. Not only are ski boots generally uncomfortable to walk in, they usually force one to walk with an unnatural, awkward and somewhat stiff gait. In order to avoid this discomfort and to enable natural unencumbered movement, many skiers completely remove their boots. The result is often soaked socks, soaked feet and eventual, if not immediate, discomfort.

Another annoyance associated with conventional ski boots is the difficulty encountered when a skier tries to remount the boots in their bindings after having walked through snow and ice. Debris including the snow and ice becomes embedded or caked on the bottom of the boots and interferes with their proper mounting. This condition usually necessitates cleaning both the boots and bindings before the boots may be remounted - an inconvenient task at best.

Conventional ski boots such as those referred to above are often available for rental at ski lodges as well as sporting goods stores. In order to accommodate the wide range of foot sizes, such rental outlets are obliged to stock a large inventory of ski boots. This inventory not only takes up significant storage space, but also requires a large capital investment.

Accordingly, the need exists for a ski boot system which not only accommodates a broad range of foot sizes within a single boot but which also allows free and natural movement while protecting a skier's foot from snow, slush and ice even after the skier has removed the boot. Another need exists for a ski boot system which minimizes or eliminates the need for removing debris from the boot when remounting the boot in its bindings.

SUMMARY OF THE INVENTION

The present invention has been designed to fulfill the needs noted above by providing a rigid outer ski boot adapted to support and protect a pliable inner sport shoe. This system allows any one of a series of varying sized sport shoes to be securely suspended within a single, standard-sized outer ski boot. Such a system not only reduces the capital investment required of ski rental facilities but also allows a growing child to use the same outer boot with a series of successively larger sized inner shoes. Since the inner shoe is considerably less expensive than the outer boot, economies are realized after a single change in shoe size. Moreover, this system allows removal of the inner shoe from the outer boot to permit free walking movement without exposing the skier's foot to the environment.

It is therefore an object of the invention to provide a ski boot system which allows any one of a series of varying sized pliable inner shoes to be securely mounted within a single rigid outer boot.

Another object is to provide a ski boot system which allows the removal of a pliable inner shoe from a rigid outer boot to permit the skier to walk naturally and comfortably without constraint.

Still another object of the invention is to provide a ski boot system wherein a pliable inner shoe is mounted within a rigid outer boot so as to suspend the shoe above the bottom of the boot thereby reducing the possibility of interference between snow and/or debris and the bottom of the shoe.

Yet another object of the invention is to provide an outer boot which may be semi-permanently mounted to a ski so that a skier need not remove the boots from their bindings in order to walk freely of the skis.

The realization of these and various other objects, features and attendant advantages of the present invention will be more fully appreciated from the following description when considered in connection with the accompanying drawings, in which the same reference numbers designate the same or corresponding parts throughout.

BRIEF DESCRIPTION OF THE DRAWINGS

The various details of the present invention are described hereinafter with reference to the drawings in which:

FIGS. 14 through 16 illustrate an alternative mounting arrangement wherein removable mounting platforms are keyed within the outer boot;

FIG. 17 is a top plan view of the platform shown in FIG. 14;

FIG. 18 is a fragmental view showing the mounting of the platform within the outer boot;

FIG. 19 is a sectional view taken through line G—G of FIG. 18; and

FIG. 20 is a perspective view of a portion of the outer boot adapted for receiving shim pads.

DETAILED DESCRIPTION OF THE PREFERRED EMBODIMENTS

Figure 1:
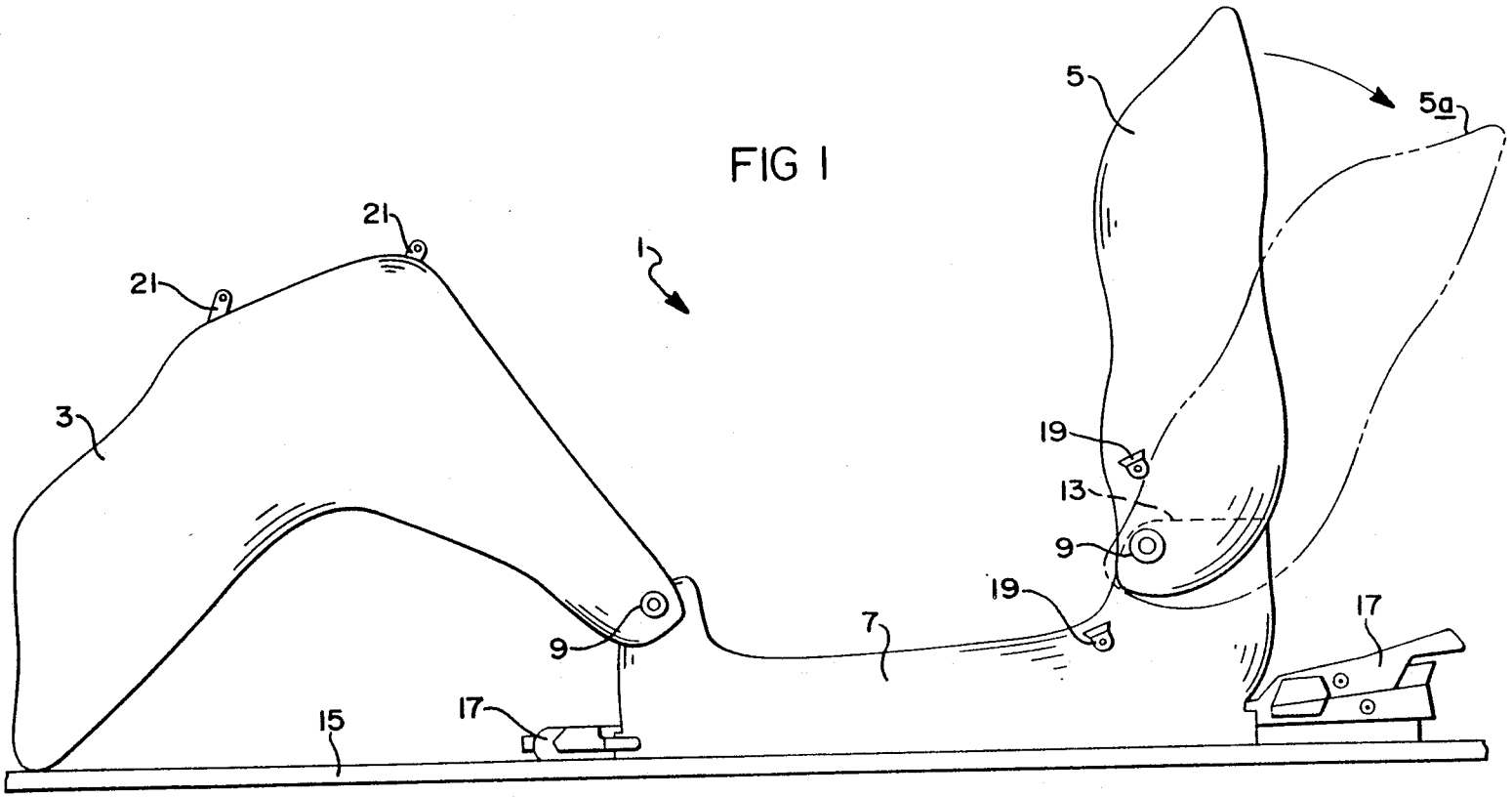
FIG. 1 is a side elevation view of an outer boot depicting in phantom an optional hinged rear cuff.

The invention will now be described in conjunction with the drawings, beginning with FIG. 1 which shows a rigid outer boot 1 having a front tongue and cuff member 3 and a rear ankle and cuff member 5. Either cuff member 3 or 5, or both, should be pivotably mounted to rigid footbed member 7 for facilitating insertion and removal of an inner shoe, as will be described below. Any pivoting fastener 9 such as a nut and bolt assembly or a rivet may be used to secure the cuff members to the footbed.

While a fixed rear cuff is shown in solid lines and described hereinafter, the rear cuff may be optionally pivotable to position 5*a* as further shown in FIG. 1. In this case, the footbed is truncated along line 13. For reference, the outer boot is shown mounted upon ski 15 with bindings 17.

Any conventional latching arrangement may be used to secure the cuff members together. For the purpose of illustration, adjustable buckles 19 are shown fixed to the rear cuff with mating hasp members 21 fixed to the front cuff.

Figures 2, 3, 4, 5, 6, 7, 8:
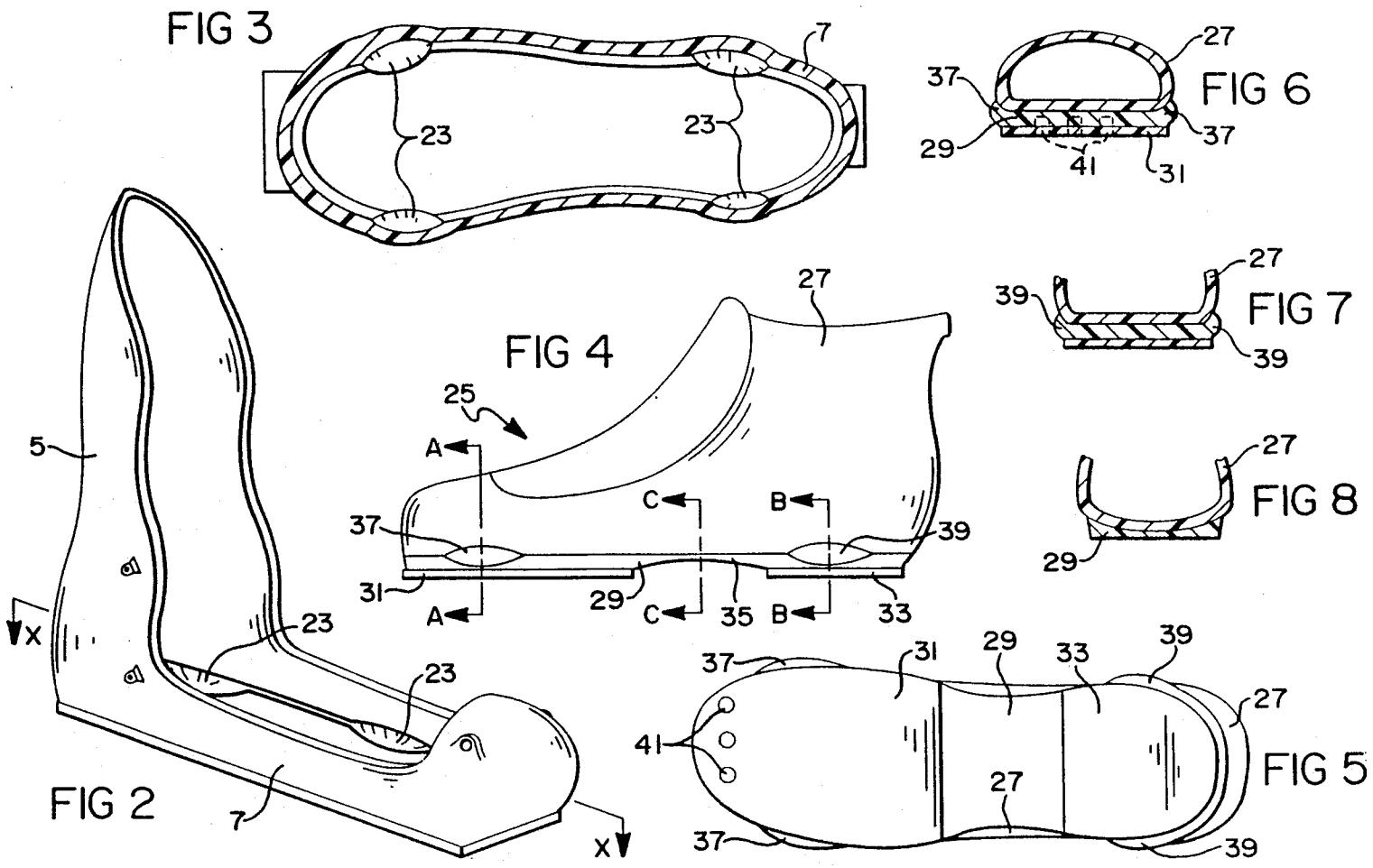
FIG. 2 is a perspective view of a portion of the outer boot.
FIG. 3 is a top plan view of the outer boot taken along line X—X of FIG. 2 showing the location of the mounting cavities.
FIG. 4 is a side elevation view of a pliable inner sport shoe.
FIG. 5 is a bottom plan view of the shoe of FIG. 4.
FIG. 6 is a sectional view taken through line A—A of FIG. 4.
FIG. 7 is a sectional view taken through line B—B of FIG. 4.
FIG. 8 is a sectional view taken through line C—C of FIG. 4.

A rigid footbed and integral rear cuff member are seen in FIG. 2. Longitudinally spaced along the inner portion of the footbed are a plurality of mounting recesses or cavities 23. Preferably, the cavities are generally arcuate in form and define spheroidal or egg-shaped surfaces. The footbed may be molded of rigid plastic material and the mounting cavities may be formed during molding. As further seen in FIG. 3, the recesses, preferably 4 in number, are substantially symmetrically disposed such that a first pair of opposed recesses are provided adjacent the skier's heel and a second pair of opposed recesses are provided adjacent the ball of the skier's foot.

A sport shoe 25 is shown in FIG. 4 for use with the outer boot 1. The shoe is formed with a soft, pliable and easily flexed upper portion 27 and relatively stiff sole portion 29. Both the upper and lower portions of the sport shoe are preferably formed of plastic materials, although the upper portion may be formed of leather or fabric, if desired.

Although optional, reinforcing support plates may be provided on the shoe for additional sole and heel support. Sole plate 31 and heel plate 33 may be blanked from sheet metal and bonded or fastened to the sole as shown. Since it is important to leave the arch section 35 as flexible as possible to facilitate walking, the support plates should not extend through this region.

Bulbous or egg-shaped projections 37,39 are shown in FIGS. 4 and 5 extending laterally from sole 29. The projections are somewhat spheroid-shaped to substantially complement the form of the recesses 23. The generally arcuate shape of the recesses and projections serves to guide the shoe to its correct mounting position within the boot and further acts to self-center the shoe therein.

A particularly useful feature is the formation of a series of holes 41 within the front end of sole 29 and plate 31. The holes are dimensioned to mate with projecting pins common to most standard cross-country ski bindings so that the inner shoe may be alternately used for cross-country skiing. Of course, any other type of cross-country fitting may be used on the shoe such as a metal loop projecting from the tip of the shoe. The holes 41 are further seen in FIG. 6, which also shows in more detail the front projections 37 and front plate 31. For clarity, FIGS. 7 and 8 respectively show sections taken through the rear projections 39 and the arch region 29.

Figure 9:
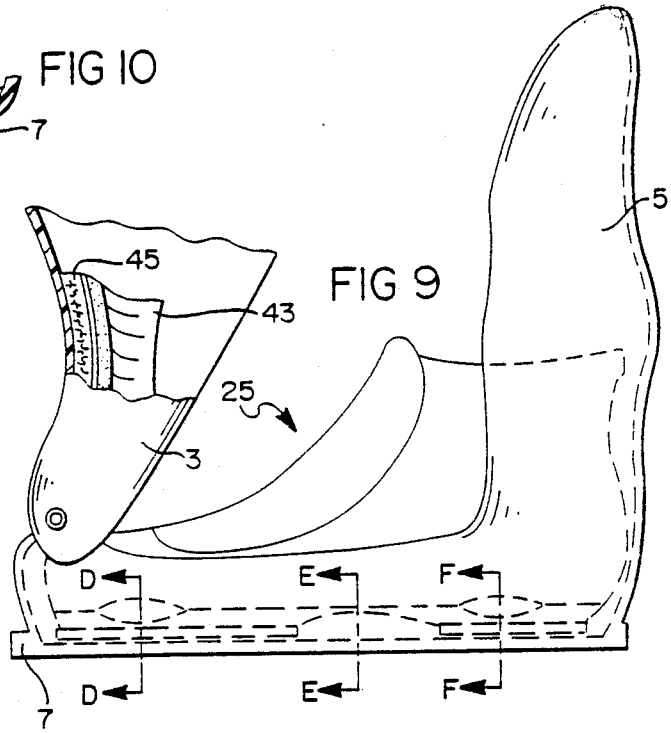
FIG. 9 is a schematic side elevation view of the inner shoe suspended within the outer boot.

The relative alignment of the inner shoe within the outer boot is shown in FIGS. 9 through 12. FIG. 9 reveals a spongelike cushion 43 removably fastened to the inner wall of the front cuff 3 by intermeshing hooked fabric fastening strips 45 or any other suitable removable fastener such as a snap fastener. Cushion 43 may be inserted or removed as needed to adjust the fit of the shoe within the boot. Additional optional padding may be similarly provided along the rear cuff as shown in FIG. 20. These cushions provide any level of desired pressure between the boot and shoe and ensure a substantially rigid inelastic connection between the projections and recesses.

Figure 10:
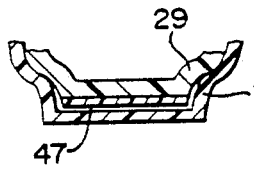
FIG. 10 is a sectional view taken through line D—D of FIG. 9.
Figure 11:
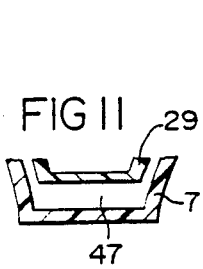
FIG. 11 is a sectional view taken through line E—E of FIG. 9.
Figure 12:
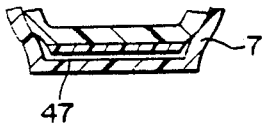
FIG. 12 is a sectional view taken through line F—F of FIG. 9.

As best seen in FIGS. 10 through 12, the sole 29 of the inner shoe is actually suspended above the floor of the footbed so as to define a continuous chamber 47 therebetween. Chamber 47 is intended to prevent interference between the boot and shoe caused by debris such as snow and ice which may become caked on the sole of the shoe. It can be further appreciated that the mounting and suspension system provides support at four points. Although spheroidal recesses and projections are preferred, any shape of complementary recesses and projections can be used. These would include orthogonal projections and recesses such as cubic shapes, or even cylindrical or trapezoidal-shaped mating surfaces.

Figure 13:
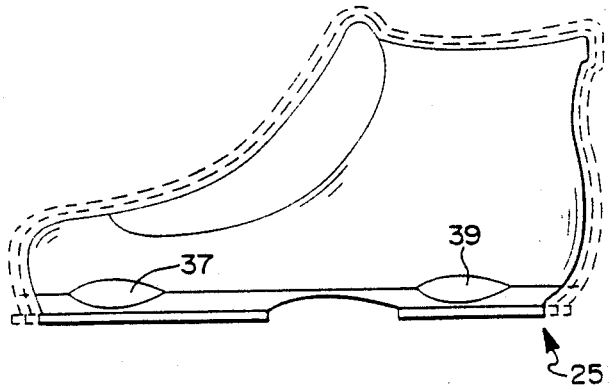
FIG. 13 is a schematic side elevation view of the inner shoe, depicting in phantom two larger sized shoes and the relative fixed location of the mounting structure in each shoe.
Figure 14:
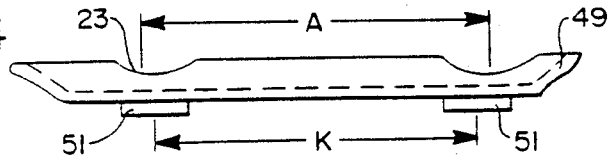
Figure 15:
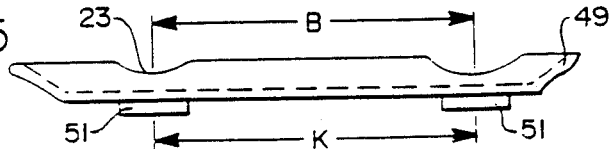

A particular advantage of the present shoe and boot system is the ability to fit various-sized shoes within the same outer boot. One manner of carrying this out is shown in FIG. 13 wherein a small shoe is shown in solid lines and two successively larger-sized shoes are shown in phantom. It is important to note that the spacing between the front and rear projections 37,39 is kept constant for each shoe so that any one of the shoes will fit within the same boot such as seen in FIG. 9. The boot must be dimensioned to provide the necessary longitudinal clearance for the largest shoe expected to be mounted therein. Cushions 43 may then be used to adjust the fit of each shoe within the boot, if necessary.

Another approach to mounting various-sized shoes within the same boot is shown in FIGS. 14 through 19 wherein easily removable mounting platforms 49 are provided with registration keys 51. The keys are longitudinally spaced apart a fixed distance K for locking the platform into corresponding cavities 53 formed in the bottom of footbed 7. Each platform is also formed with recesses 23 longitudinally spaced apart a distance A, B, C, etc., depending upon the size of shoe to be fitted within the boot. Shoe 25 would in this case then have projections 37,39 spaced apart a distance A, B, or C depending on the size of the shoe so that each shoe would have spaced projections complementing the location of the recesses formed in one of the platforms. A cavity such as cavity 47 shown in FIGS. 10 through 12 can be easily designed into this arrangement as well. This suspension and mounting arrangement allows the custom placement of the projections and extensions to optimize system performance and comfort. As noted above, the connections between the recesses and projections is quite rigid and inelastic to further promote performance.

It can be appreciated that the ski boot system described herein offers convenience and comfort not available with conventional ski boots. The inner shoe is primarily designed as a stylish walking shoe which can be quickly and easily released from the outer boot while leaving the outer boot bound to a ski.

Obviously, numerous modifications and variations of the present invention are possible in light of the above teachings. It is therefore to be understood that within the scope of the appended claims, the invention may be practiced otherwise than as specifically described herein. For example, the sport shoe may be provided with the mounting recesses and the boot provided with the corresponding mounting projections.

What is claimed is:

1. A sport ski shoe for use with a ski boot, comprising:

a pliable upper portion for covering a skier's foot; and a lower sole portion having substantially rigid mounting means for mounting said shoe within said ski boot, said mounting means comprising laterally spaced contoured support surfaces projecting laterally from opposite side portions of said sole for rigidly engaging complementary contoured support surfaces provided

2. The shoe of claim 1 wherein said support surfaces define arcuate surface portions for facilitating alignment of said shoe within said boot.

3. The shoe of claim 2 wherein said arcuate surface portions comprise spheroidal surface contours.

4. The shoe of claim 1 further comprising engagement means for attaching said shoe to a cross-country ski binding.

5. The shoe of claim 4 wherein said engagement means comprises at least one recess formed within said lower sole for receiving a projection provided on said cross-country ski binding.

* * * * *

UNITED STATES PATENT AND TRADEMARK OFFICE

CERTIFICATE OF CORRECTION

PATENT NO. : 4,979,319

DATED : December 25, 1990

INVENTOR(S) : Jaye B. Hayes

It is certified that error appears in the above-identified patent and that said Letters Patent is hereby corrected as shown below:

Claim 1, line 9, after "provided" the following should be added -- in side portions of said boot so as to suspend said shoe within said boot.--.

Signed and Sealed this

Sixteenth Day of June, 1992

*Attest:*

DOUGLAS B. COMER

*Attesting Officer*

*Acting Commissioner of Patents and Trademarks*